US008553238B2

(12) United States Patent
Hirose et al.

(10) Patent No.: US 8,553,238 B2
(45) Date of Patent: Oct. 8, 2013

(54) MEDIA SEPARATOR, FIXING DEVICE, AND IMAGE FORMING APPARATUS

(75) Inventors: Fumihiro Hirose, Kanagawa (JP); Takeshi Yamamoto, Kanagawa (JP); Takashi Seto, Kanagawa (JP); Kenichi Hasegawa, Kanagawa (JP); Naoto Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 13/205,005

(22) Filed: Aug. 8, 2011

(65) Prior Publication Data

US 2012/0044516 A1 Feb. 23, 2012

(30) Foreign Application Priority Data

Aug. 19, 2010 (JP) ..... 2010-183864
May 25, 2011 (JP) ..... 2011-117036

(51) Int. Cl.
*B65H 3/14* (2006.01)

(52) U.S. Cl.
USPC ..... 358/1.1; 358/474; 358/498; 399/323; 271/97; 271/98

(58) Field of Classification Search
USPC ..... 399/323, 322; 271/18, 19
See application file for complete search history.

(56) References Cited

U.S. PATENT DOCUMENTS 4,708,333 A * 11/1987 Servi et al. ..... 270/45
6,678,497 B1 * 1/2004 Murata ..... 399/323
8,145,109 B2 * 3/2012 Ishikawa ..... 399/323
8,162,315 B2 * 4/2012 Baba ..... 271/312
8,249,491 B2 * 8/2012 Hirose et al. ..... 399/323
8,433,230 B2 * 4/2013 Seto et al. ..... 399/323
2007/0147912 A1 * 6/2007 Fujii ..... 399/323
2009/0274492 A1 * 11/2009 Ishikawa ..... 399/323
2009/0279928 A1 * 11/2009 Ishikawa ..... 399/323
2011/0164904 A1 7/2011 Hirose et al.
2011/0182609 A1 7/2011 Hasegawa et al.
2011/0217091 A1 * 9/2011 Hirose et al. ..... 399/323
2012/0014725 A1 * 1/2012 Seto et al. ..... 399/323
2012/0045260 A1 * 2/2012 Yamamoto et al. ..... 399/323

FOREIGN PATENT DOCUMENTS

JP 55-73956 6/1980
JP 60-247672 12/1985
JP 61-59468 3/1986
JP 2581429 11/1996
JP 2004-212954 7/2004

(Continued)

OTHER PUBLICATIONS

U.S. Appl. No. 12/986,425, filed Jan. 7, 2011, Takashi Seto, et al.

*Primary Examiner* — Twyler Haskins
*Assistant Examiner* — Dennis Dicker
(74) *Attorney, Agent, or Firm* — Oblon, Spivak, McClelland, Maier & Neustadt, L.L.P.

(57) ABSTRACT

A media separator includes air nozzles and separation plates to form a row of members, and is configured to separate a sheet conveyed from a fixing nip formed of a fixing member and a pressure member. In such a media separator, the plurality of air nozzles and at least one separation plate are disposed along a longitudinal direction of the fixing device, and the plurality of air nozzles are disposed at both lateral ends of the row of members in the longitudinal direction of the fixing device, whereby waving of the edge of the sheet in the printing of frequently used sheet can be prevented and the occurrence of jam may be prevented, and a stable sheet separation and conveyance can be realized.

11 Claims, 13 Drawing Sheets

(56) References Cited

FOREIGN PATENT DOCUMENTS

| | | |
|---|---|---|
| JP | 2005-49647 | 2/2005 |
| JP | 2005-121726 | 5/2005 |
| JP | 2005-128333 | 5/2005 |
| JP | 2005-157179 | 6/2005 |
| JP | 2005-202043 | 7/2005 |
| JP | 2005-258035 | 9/2005 |
| JP | 2007-79411 | 3/2007 |
| JP | 2007-199462 | 8/2007 |
| JP | 2008-83475 | 4/2008 |
| JP | 4370845 | 9/2009 |
| JP | 4396784 | 10/2009 |
| JP | 2009-271115 | 11/2009 |
| JP | 2009-271345 | 11/2009 |

* cited by examiner

MEDIA SEPARATOR, FIXING DEVICE, AND IMAGE FORMING APPARATUS

CROSS-REFERENCE TO RELATED APPLICATIONS

The present application claims priority from Japanese patent application numbers 2010-183864 and 2011-117036, filed on Aug. 19, 2010, and May 25, 2011, respectively, the entire contents of which are incorporated by reference herein.

BACKGROUND OF THE INVENTION

1. Field of the Invention

The present invention relates to a media separator to separate a recording medium for a fixing member by compressed air injection, a fixing device, and an image forming apparatus.

2. Description of the Related Art

Image forming apparatuses including a fixing device such as a fixing roller to fix with heat and pressure an unfixed toner image onto a recording medium such as a sheet of paper have conventionally been widely known. Such fixing device is heated by a heat source such as a halogen heater. A pressure member such as a pressure roller is provided to press the fixing member. The sheet carrying the unfixed toner image thereon passes through a nip formed between the fixing member and the pressure member, and the toner image is fixed onto the sheet with heat and pressure.

A belt fixing method using a fixing belt as a fixing member is also well known. The fixing belt has a low thermal capacity and therefore can reduce warm-up time, and is energy efficient as well.

In the thermal fixing device as described above, because the toner image fused onto the sheet may contact the fixing roller or the fixing belt, the fixing roller or the fixing belt are coated with fluorine resins having excellent releasability. In addition, a separation claw is used to separate the sheet from the fixing member. A drawback of the separation claw, however, is a tendency to scrape a surface of the roller or the belt due to direct contact with the roller or the belt, which may produce streaks in an output image.

In general, in monochrome image printing, the fixing roller is configured to use a metal roller coated with TEFLON® (polytetrafluoroethylene, PTFE), with the result that its surface is strong enough to withstand scrapes due to the direct contact of the separation claw and its lifetime is long.

However, in color image formation, the fixing roller formed of a silicon rubber surface layer coated with fluorine resins (which is in general a Perfluoroalkoxy (PFA) tube several tens of microns thick) or a silicon rubber with a surface coated with oil is used to improve coloring effects. Such a roller has a soft surface layer which is apt to be damaged. If the surface layer is damaged, a streak-like flaw is generated on the fixed image. Accordingly, a contact means such as a separation claw is no longer used in the color image forming apparatus and instead a non-contact sheet separation has become the industry standard.

In the non-contact sheet separation configuration, if the adhesion between the toner and the fixing member is high, the sheet after fixation tends to wind around the roller of the belt, whereby a paper jam occurs easily. In color image formation in particular, because several toner layers are superimposed on the sheet one after another, the adhesiveness increases, thereby causing a paper jam to occur easily.

Accordingly, as a non-contact separation means, it is proposed to inject air to sheet separation position and is used.

JP-S61-59468-A discloses a fixing device to separate a sheet by injecting compressed air to a position between the sheet and the fixing roller even in a case of a sheet with a lower basis weight.

The air separation mechanism in which a recording medium is separated from the roller by a force of the compressed air as disclosed in JP-S61-59468-A includes a nozzle to inject compressed air. The compressed air is directed toward the recording medium to be conveyed from the nip portion outlet between the fixing roller and the pressure roller to separate the recording medium from the roller.

However, as illustrated in FIG. 16, when the basis weight of the sheet is large, the amount of toner carried on the edge portion of the sheet and on the entire sheet is small, and the sheet does not absorb moisture, the sheet does not wind around the fixing roller, is separated therefrom, and is conveyed from the nip portion. By contrast, if the sheet basis weight is large, an abundant amount of toner is carried on the sheet, and the sheet absorbs moisture, that is, in a state in which the sheet tends to wind around the fixing roller, the sheet is separated and conveyed while winding around the fixing roller from the nip end portion as illustrated in FIG. 17, whereby an excessive amount of heat beyond that which is necessary is applied to the toner and defective images are formed.

To separate and convey the sheet without the sheet wrapping around the roller, the pressure and the flow amount of the injected compressed air need to be increased. However, excessive pressure of the compressed air destabilizes moving of the type of the sheet with a large basis weight, less unfixed toner amount on a leading edge and on an entire surface, and without moisture absorbed, thereby causing defective conveyance of the sheet.

SUMMARY OF THE INVENTION

Accordingly, the present invention provides a novel media separator including air injection nozzles and separation plates capable of stably separating and conveying a sheet while preventing it from winding around the roller, a novel fixing device, and an image forming apparatus.

As an aspect of the present invention, an optimal media separator includes air nozzles and separation plates to form a row of members, the media separator being configured to separate a sheet conveyed from a fixing nip formed of a fixing member and a pressure member, in which the plurality of air nozzles and at least one separation plate are disposed along a longitudinal direction of the fixing device, and the plurality of air nozzles are disposed at both lateral ends of the row of members in the longitudinal direction of the fixing device.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIG. 8 is a schematic view illustrating a relation between a sheet and the media separator when a printable maximum-sized sheet is passed through;

DESCRIPTION OF THE PREFERRED EMBODIMENTS

Preferred embodiments of the present invention will now be described with reference to the drawings.

Figure 1:
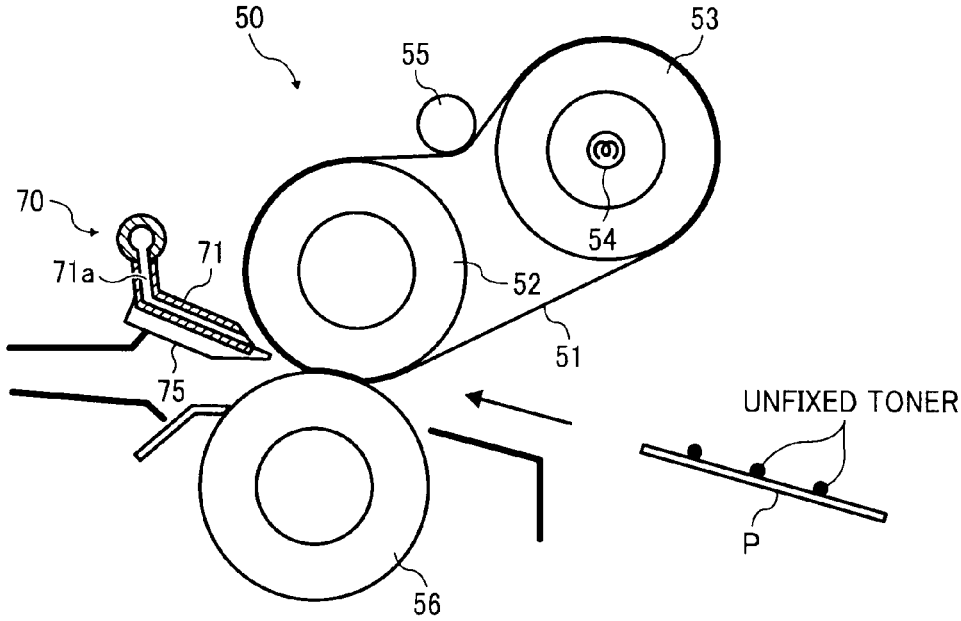
FIG. 1 is a cross-sectional view illustrating a main part configuration of a fixing device according to an embodiment of the present invention.

FIG. 1 is a cross-sectional view illustrating a main part of a fixing device according to one embodiment of the present invention. The fixing device as illustrated in FIG. 1 is of a belt fixing method type using a fixing belt. However, the present invention is not limited thereto and may be applied to a roller fixing method type using a fixing roller with the same advantages.

In the fixing device 50 as illustrated in FIG. 1, a fixing belt 51 as a fixing member is supported by and stretched over a fixing roller 52 and a heat roller 53 and is rotated in the clockwise direction. The fixing roller 52 is a drive roller and the heat roller 53 is a driven roller. The fixing roller 52 includes a metal core and an elastic layer formed on the metal core, and is driven to rotate by a drive means, not shown. The heat roller includes a built-in fixing heater 54 as a heat source. The heat roller 53 is heated by the heater 54 and the fixing belt 51 is heated by the heat roller 53.

The pressure roller 56 includes an elastic layer and is so arranged as to press against the fixing roller 52 via the fixing belt 51 by a pressing mechanism, not shown. The fixing belt 51 is rotatably driven as the fixing roller 52 is driven to rotate, and a pressure roller 56 is driven accompanied by the fixing belt 51. Optionally, the pressure roller 56 may be communicated with a driving source, and may include a heater to heat the pressure roller 56.

The surface temperature of the fixing belt 51 is detected by a temperature detector, not shown. A temperature controller, not shown, is configured to control the fixing heater 54 based on the detected output value of the temperature detector.

A sheet P on which an unfixed toner image is carried is conveyed from right to left in FIG. 1 and is inserted into a nip portion formed between the fixing belt 51 and the pressure roller 56 which are pressed against with each other. In the nip portion, controlled to a predetermined temperature, between the fixing belt 51 and the pressure roller 56, toner is fused and fixed onto the sheet, and the sheet P is discharged. It is to be noted that although the pressure member is a pressure roller in the present embodiment, alternatively a pressure belt may be used instead.

A tension roller 55 is disposed at an outside of the fixing belt 51 between the fixing roller 52 and the heat roller 53, and a predetermined tension is applied to the fixing belt 51. It should be noted that the tension roller 55 is disposed outside the fixing belt 51 in the present embodiment, but may be disposed either outside or inside of the fixing belt 51.

A media separator 70 is disposed near the downstream end of the fixing nip. The media separator 70 will be described later in detail with reference to FIG. 3. FIG. 1 shows an air nozzle 71 and a separation plate 75, both of which are included in the media separator 70. An air passage 71*a* is formed inside the air nozzle 71.

Figure 2:
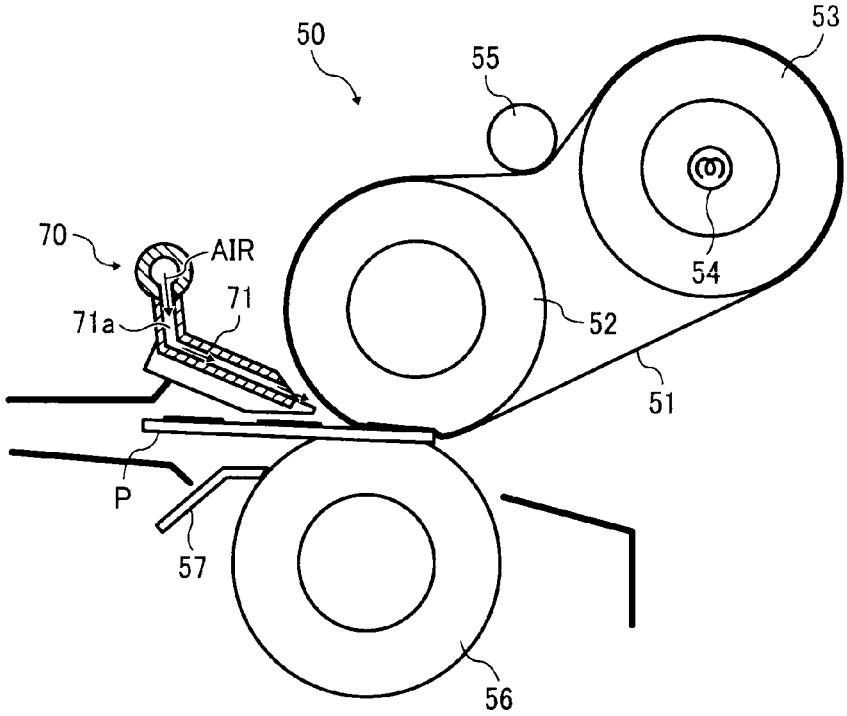
FIG. 2 is a schematic view of the fixing device illustrating a state in which a sheet is separated.

As illustrated in FIG. 2, compressed air is injected from the air nozzle 71 generally toward the nip direction, whereby an edge portion of the sheet P which has passed through the nip is forcibly separated from the fixing belt 51 by the flow of the injected compressed air. The separated sheet P is guided by the separation plate 75 and a not-illustrated guide plate disposed downstream of the separation plate 75 to be discharged from the fixing device. In the present embodiment, the duration of compressed air injection when the leading edge of the sheet is separated is 75 milliseconds.

Figure 3:
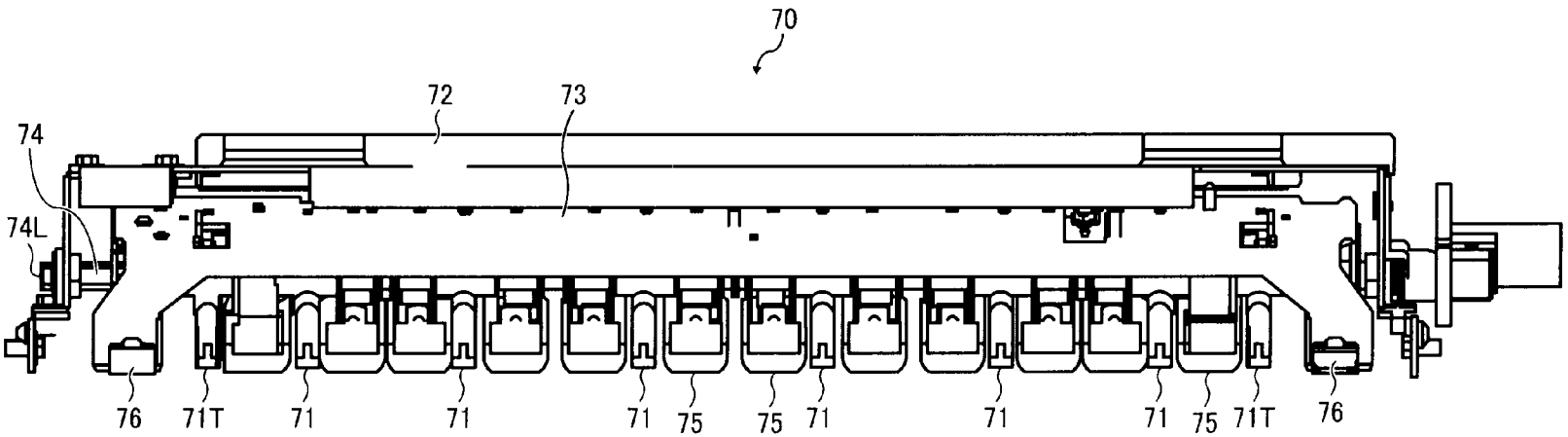
FIG. 3 is a plan view illustrating a media separator disposed in the vicinity of an end of a fixing nip.

FIG. 3 is a plan view illustrating a media separator disposed in the vicinity of the downstream end of the fixing nip. The media separator 70 includes a frame 72 fixed to a casing of the fixing device, and a stay 73 rotatably supported via a shaft 74 to the frame 72. In the present embodiment, the stay 73 is fixed to the shaft 74, and the shaft 74 is rotatably supported to the frame 72 via the shaft bearing. Contact members 76 are disposed at both lateral end positions of the stay 73 and outside of a sheet printing area. A biasing member, such as a spring, not shown, disposed between the frame 72 and the stay 73, serves to press the contact members 76 against the fixing belt 51 or the fixing roller 52. The tip ends of the contact members 76 contact the fixing belt 51 (or the fixing roller 52) and slidably move, thereby enabling positioning of the air nozzles 71 and the separation plate 75 both attached to the shaft 74 and controlling a gap with the fixing belt 51 accurately.

By contacting the leading edge of the contact members 76 disposed at non-printing areas with the fixing member to position the air nozzles 71 and the separation plates 75, the air nozzles 71 and the separation plates 75 are positioned without contacting the fixing member, thereby preventing abrasion of the fixing member in the non-printing area.

A plurality of air nozzles 71 and at least one separation plate 75 are disposed on the shaft 74. In the exemplary embodiment, a total of 8 air nozzles 71 and a total of 12 separation plates 75 are disposed in the longitudinal direction of the fixing roller 52. Two air nozzles positioned at lateral outermost edges in the shaft direction among the total of 8 air nozzles 71 are applied with a suffix 'T' as in '71T'. As illustrated in FIG. 3, those two air nozzles 71T, 71T at both edges are disposed outside the separation plates 75. Specifically, the air nozzles 71T, 71T are disposed at both outermost edges of the row of members formed of air nozzles 71 and separation plates 75.

Figure 4:
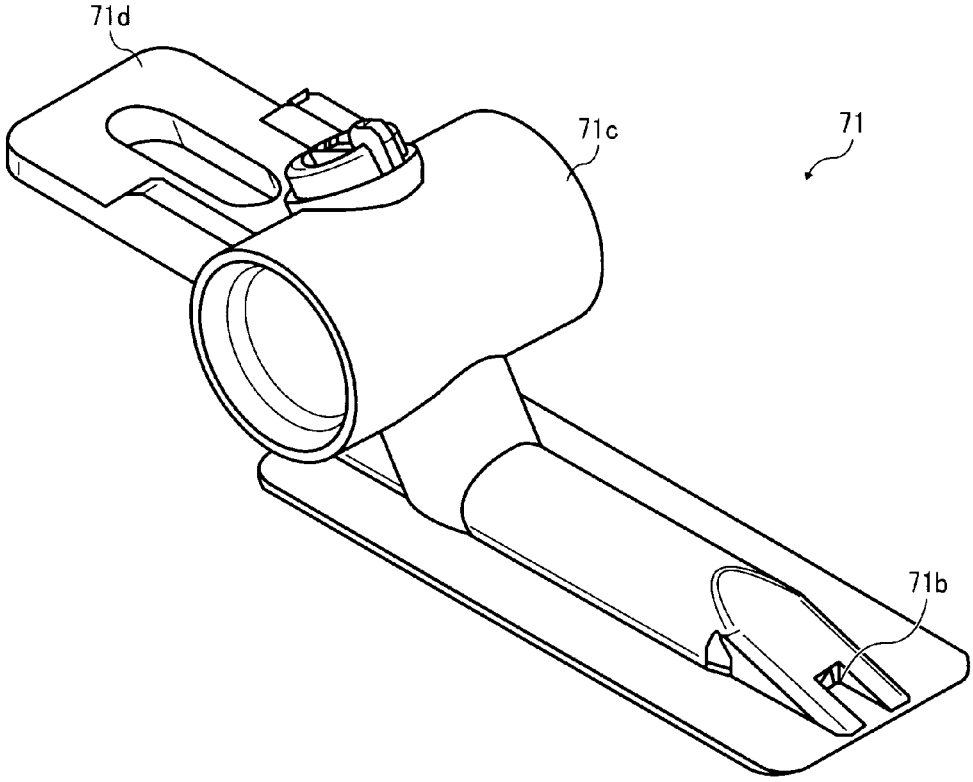
FIG. 4 is a perspective view illustrating an air nozzle.

FIG. 4 is an oblique perspective view illustrating an air nozzle 71. As illustrated in FIG. 1, each of the air nozzles 71 includes an air passage 71*a* in an interior thereof. An air outlet 71*b* of the compressed air is provided at a leading edge of the nozzle. A cylinder-shaped shaft attachment 71*c* engages the shaft 74, and the air nozzle 71 is attached to and supported by the shaft 74. In addition, an adjustment plate 71*d* protrudes from and is arranged on the shaft attachment 71*c*. The air nozzle 71 is formed of, for example, fluorine resins such as PFA resins. Otherwise, the leading edge portion or the lower bottom surface which a sheet directly contacts may be coated with fluorine resins such as PFA.

Figure 5:
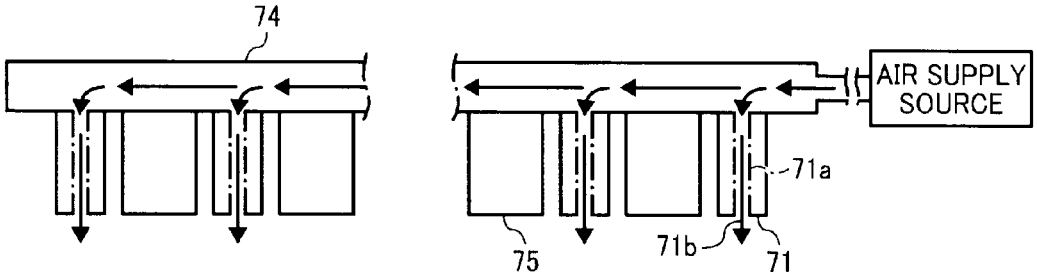
FIG. 5 is a schematic view illustrating a state in which compressed air supplied from an air supply source is injected from air nozzles.

The shaft 74 includes a built-in hollow shaft, not shown, and the hollow shaft communicates with the air passage 71*a* for each air nozzle 71. As schematically illustrated in FIG. 5, the hollow shaft supplies compressed air supplied from an air supply source formed of an air pump or compressor, an air tank, and the like, to each air nozzle 71, and the compressed air is injected from the air outlet 71*b*. As illustrated in FIG. 3, an end 74L of one side of the shaft 74 is sealed, and the air supply source is connected with another end of the shaft 74 via the compressed air passage.

Figure 6:
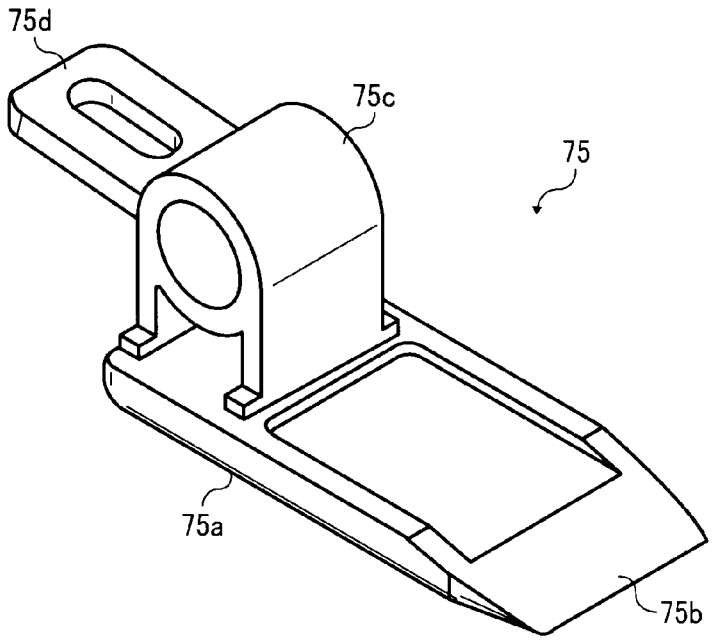
FIG. 6 is an oblique perspective view illustrating a separation plate.

FIG. 6 is an oblique view of the separation plate 75. The separation plate 75 is formed of a platelet separation guide 75*a*, a shaft attachment 75*c*, and an adjuster 75*d* provided to protrude from the shaft attachment 75*c*. A leading edge of the separation guide 75*a* has a tapered leading edge separator 75*b*. The separation plate 75 is formed, for example, of fluorine resins such as PFA resins. Otherwise, the leading edge and the bottom surface facing the sheet guide may be coated with fluorine resins such as PFA resins.

Figure 7:
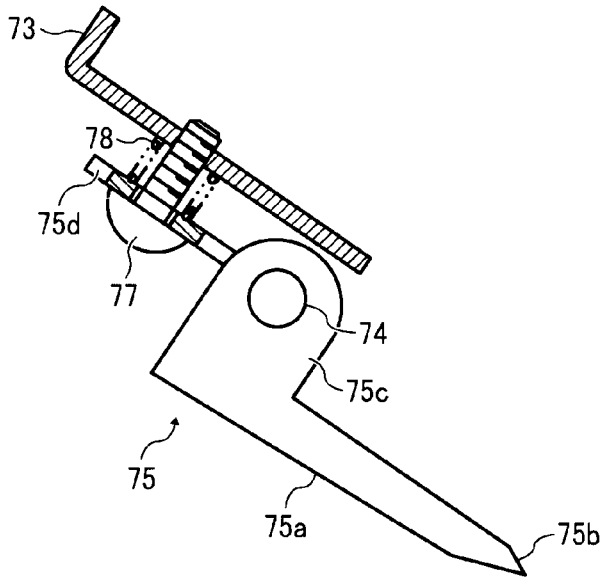
FIG. 7 is a cross-sectional view illustrating a gap adjuster disposed on the separation plate.

The shaft attachment 71*c* of the air nozzle 71 and the shaft attachment 75*c* of the separation plate 75 are fitted with the shaft 74 so that the air nozzle 71 and the separation plate 75 rotatably move about the shaft 74 and are not fixed to the shaft 74. Then, the air nozzle 71 and the separation plate 75 are provided with a gap adjuster unit which will be described with reference to FIG. 7. In FIG. 7, the gap adjuster unit will be described using the separation plate 75, but the gap adjuster unit may also function in relation to the air nozzle 71.

FIG. 7 shows the stay 73 fixed to the shaft 74 (see also FIG. 3). The separation plate 75 engages the shaft 74 so as to be movable with respect to the shaft 74. A screw 77 is inserted into a slit (see FIG. 6) of the adjustor 75*d* protruded from the shaft attachment 75*c*. Further, a leading edge of the screw 77 is screwed into a screw hole provided on the stay 73. Compression springs 78 fit in the shank of the screw 77 reside between the stay 73 and the adjuster 75*d*. Accordingly, the compression springs 78 give pressing force to the adjuster 75*d* so as to move about the shaft 74 counterclockwise in FIG. 7, that is, in such a direction that the leading edge separator 75*b* of the separation plate 75 comes close to the fixing belt 51 (see FIG. 1). When the screw 77 is fastened, the separation plate 75 moves clockwise and when the screw 77 is loosened, the separation plate 75 moves counterclockwise, thereby enabling fine adjustment of a gap between the leading edge of the separation plate 75 and the fixing belt 51. The same is applied to the air nozzle 71, and a gap between the air outlet 71*b* provided at the tip end of the nozzle and the fixing belt 51 may be finely adjusted.

Figure 8:
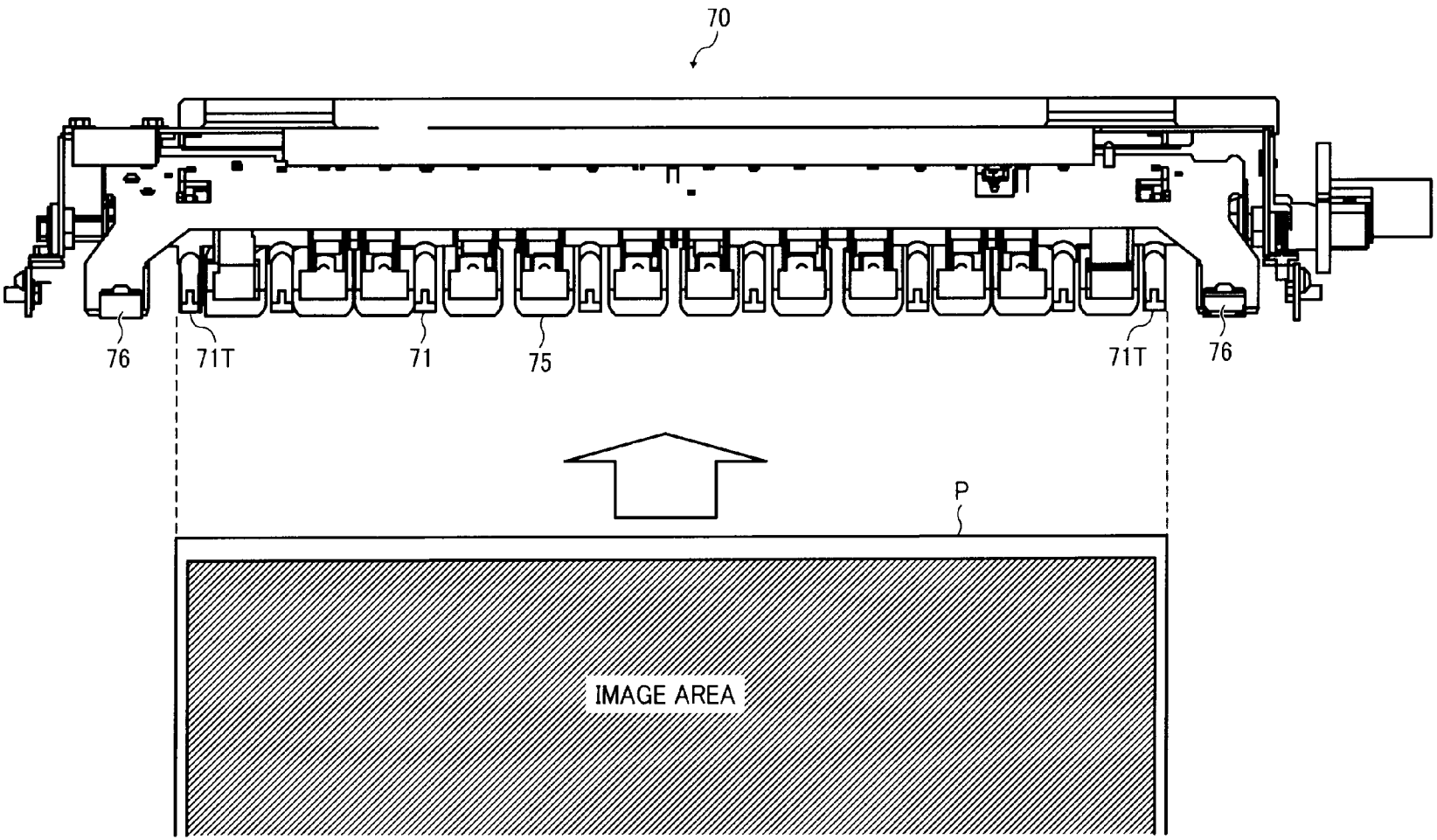

FIG. 8 is a schematic view illustrating a relation between a sheet and the media separator 70 when a printable maximum-sized sheet is passed in the preferred embodiment.

The sheet P illustrated in FIG. 8 is a printable maximum-sized sheet and is called SRA3 size sheet in 320×450 mm. The sheet passing width is 320 mm. As described above, the media separator 70 includes a plurality of the air nozzles 71 and a plurality of the separation plate 75 which are positioned as illustrated in FIG. 8. The end air nozzles 71T, 71T are disposed at outermost positions. The positions of the end air nozzles 71T, 71T in the shaft direction of the fixing roller 52 are substantially coincident with the positions of the edges of the sheet when the printable maximum-sized sheet P is passed, so that the edges of the sheet are pressed by the compressed air injected from the end air nozzles 71T, 71T. In the present embodiment, the positions of the end air nozzles 71T, 71T in the shaft direction of the fixing roller 52 are within a width of the maximum-sized sheet.

Figure 9:
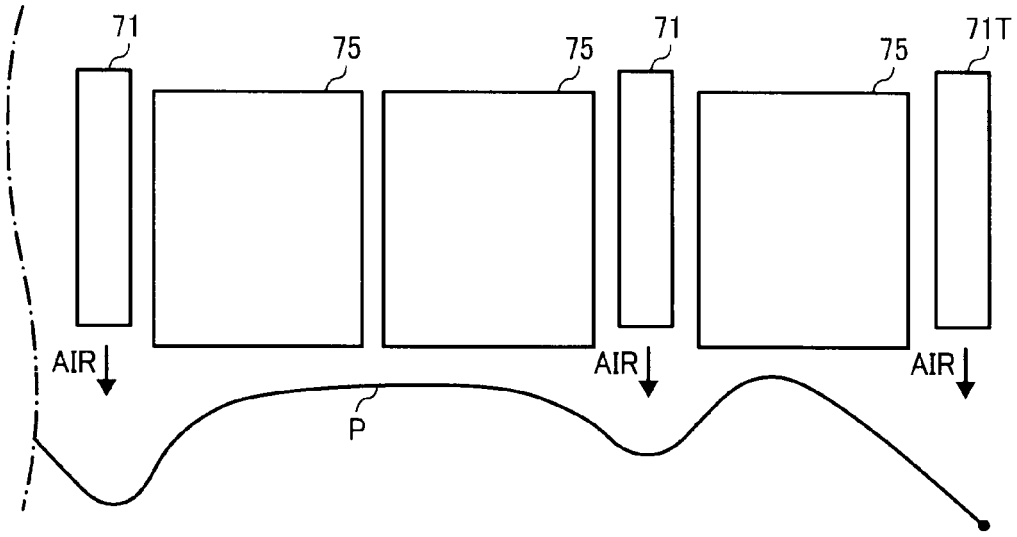
FIG. 9 is a schematic perspective view illustrating a state of the sheet edge portion seen from a sheet discharge direction.

FIG. 9 schematically shows a state of an edge of a sheet seen from the sheet ejection direction. The edge of the sheet is pressed by the compressed air injected from the end air nozzle 71T, whereby the sheet does not contact the separation plate 75 nor the air nozzle 71 (and 71T) and is separated and conveyed without jamming. As is described later with reference to FIG. 11, when the air nozzle is disposed within an inner side of the separation plate, the effect of the compressed air injected from the nozzle is weakened at the end of the sheet, the sheet edge portion cannot be pressed properly, and the sheet jam occurs. However, the present embodiment can solve the problem of the occurrence of jam by restricting the waving in the edge of the sheet, and the sheet can be separated and conveyed stably.

As can be seen from FIGS. 8 and 9, the leading edge of the air nozzle 71 is positioned downstream of the leading edge of the separation plate 75 in the sheet conveyance direction, that is, the separation plate 75 protrudes beyond the air nozzle 71. This is because the air nozzle 71 blows the compressed air to the edge of the sheet, and the separation plate 75 contacts the sheet, separates and guides it.

As described above, the media separator 70 of the present embodiment includes a gap between the tip of the separation plate 75 and the surface of the fixing belt 51 and the gap is finely adjustable. The leading edge gap of the separation plate 75 may preferably be set as narrow as 0.1 to 0.2 mm when a thin paper is used for printing. This is because, even though the air separation unit is provided, air separation effect at a position in the shaft direction of the fixing roller 52 in which compressed air is not injected is weak, and consequently the sheet needs to be separated by the separation plate 75. By making the leading edge gap to be narrow, separation of the thin paper may be secured. At the same time, by providing a separation plate, scratches and traces in the image may be prevented.

Figure 10:
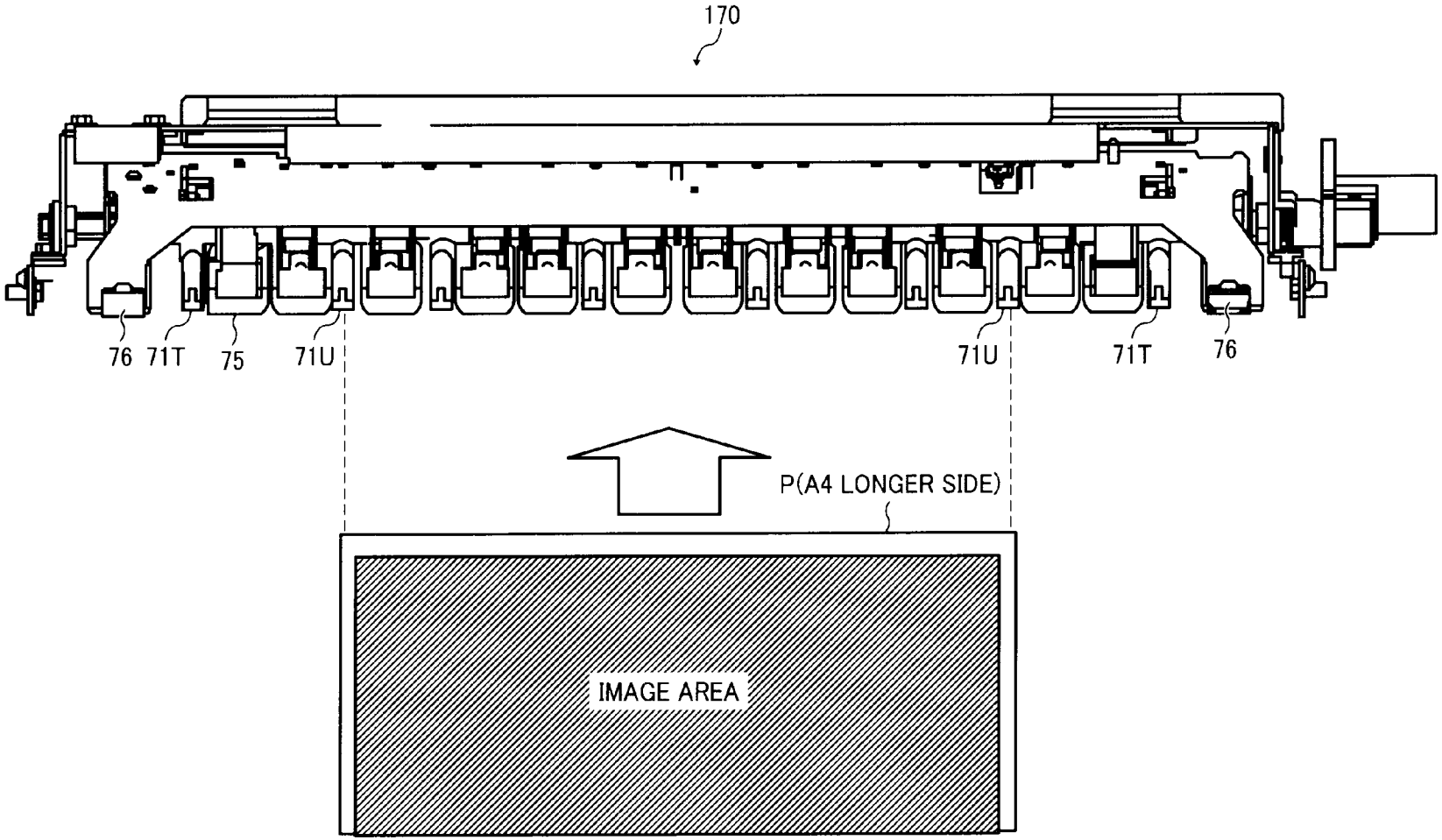
FIG. 10 is a plan view illustrating a second embodiment of the media separator.

FIG. 10 is a diagram illustrating a second embodiment of the media separator. As illustrated in FIG. 10, a media separator 170 according to the second embodiment is identical to the media separator 70 according to the first embodiment except that the disposition of part of air nozzles 71 among a plurality of air nozzles 71 is different. (It is noted that the disposition of part of separation plates 75 also changes due to change in the disposition of part of air nozzles 71.) Therefore, the duplicated explanation will be omitted and different part will now be mainly described.

In the media separator 170 as illustrated in FIG. 10, the printable maximum-sized sheet is SRA3 size sheet in 320×450 mm as in the first embodiment, and the width for printing is 320 mm. The edge air nozzles 71T, 71T are disposed to be coincident with the both lateral ends of the SRA3 size sheet similarly to the case of media separator 70 of the first embodiment.

In the media separator 170 according to the second embodiment, air nozzles 71U, 71U being the inner second nozzles from the edge air nozzles 71T, 71T are disposed at positions corresponding to both edges of an A4-sized sheet (210×297 mm) with its shorter side (210 mm) parallel to the sheet passing direction. In addition, the reference position for printing is at the center of the fixing device and of the image forming apparatus to which the media separator 170 is disposed.

With such a configuration, because the media separator 170 according to the second embodiment includes two air nozzles 71U, 71U which are disposed at positions corresponding to both lateral ends of the A4-sized sheet which is frequently used in the common image forming apparatus, the waving of the edge of the sheet in the printing of frequently used sheet can be prevented and the occurrence of jam may be prevented, whereby a stable sheet separation and conveyance can be realized.

Meanwhile, in the above embodiment, the representative sheet size is assumed to be an A4-size, and the air nozzles 71U, 71U are disposed at positions corresponding to the width of the A4-sized sheet. However, it is not limited to the A4-sized sheet, the representative size may be arbitrary set to be as A3, A4, B5, or the like, and the air nozzles may be disposed correspondingly.

Figure 11:
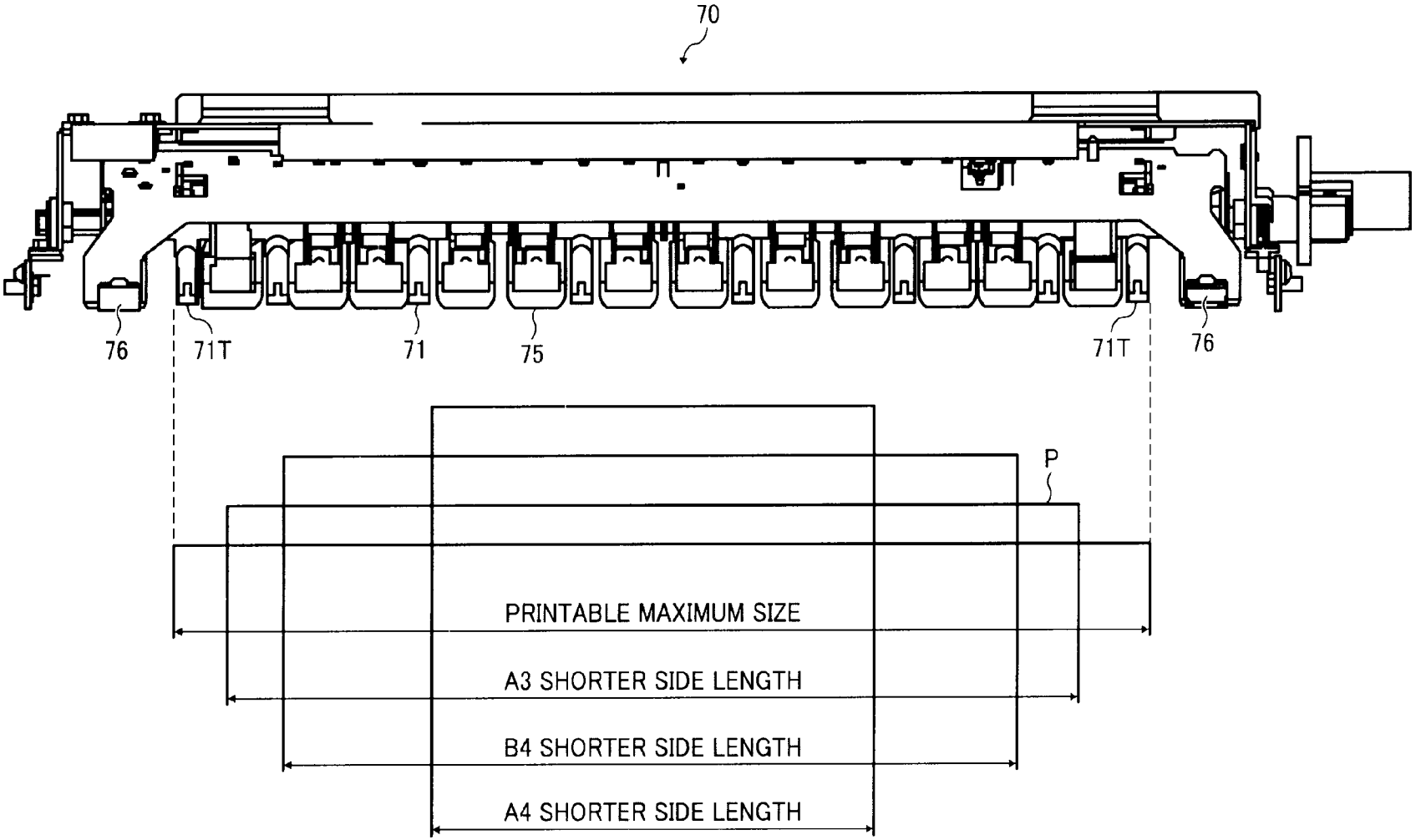
FIG. 11 is a view illustrating a relation between the media separator and the sheet size.

With reference to FIG. 11, a relation between the media separator and the sheet size will now be described. FIG. 11 illustrates a case of the media separator 70 according to the first embodiment, but the relation will be applied to the case of the media separator 170 according to the second embodiment.

As described in FIG. 11, a width of the printable maximum-sized sheet means that of an irregular-sized sheet longer than the shorter side width of the standard A3 sheet. In addition, a width of the maximum-sized standard sheet among the recording media with a size shorter than the width of the printable maximum-sized sheet means, in the present embodiment, a shorter side length of the standard A3-sized sheet. The standard sheet is not limited to the A-series, but there is also B-series as another series of standard size of paper defined as Japanese Industrial Standards (JIS).

As described above, the media separator according to the present invention is configured to include air nozzles and separation plates disposed parallel to the longitudinal direction of the fixing roller or the fixing belt, and the air nozzles at both lateral ends are disposed at outermost positions which are in the outer side than the separation plate, whereby when the maximum-sized sheet is to be separated, waving of the sheet at its end portions is prevented and the occurrence of paper jam is prevented, and the stable sheet separation and conveyance can be performed.

Figure 12:
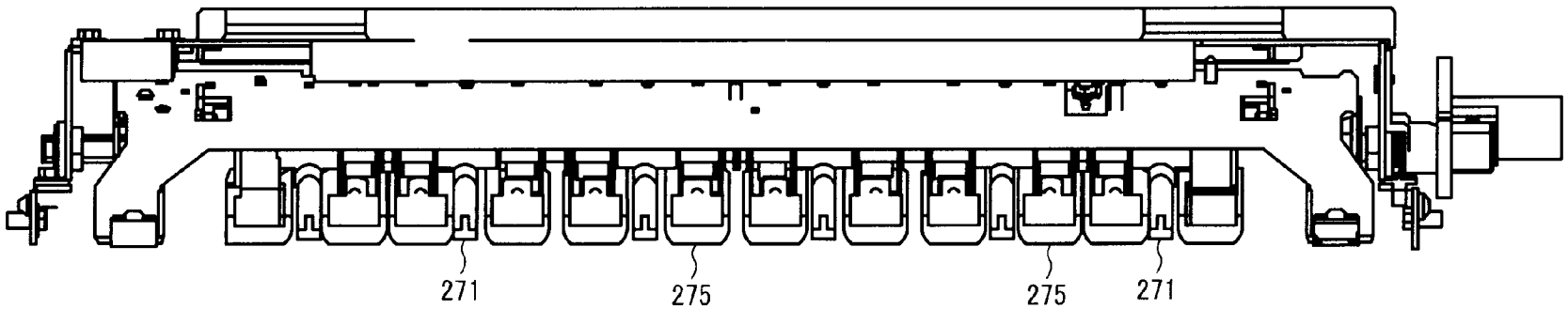
FIG. 12 BACKGROUND ART
FIG. 12 is a plan view illustrating an example of the media separator including air nozzles and separation plates.
Figure 13:
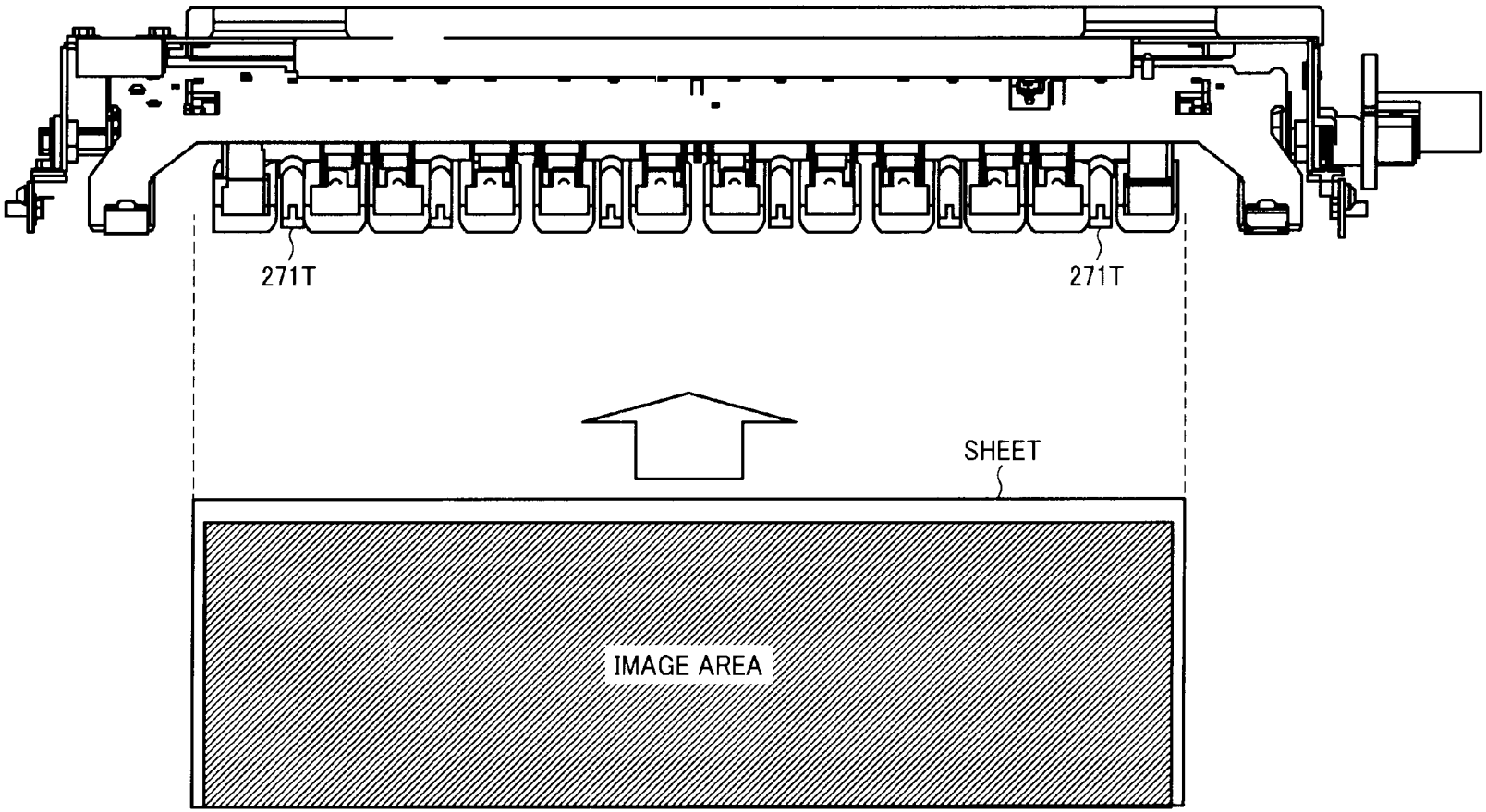
FIG. 13 BACKGROUND ART
FIG. 13 is a plan view illustrating a relation between the air nozzles in the media separator of FIG. 12 and the sheet.
Figure 14:
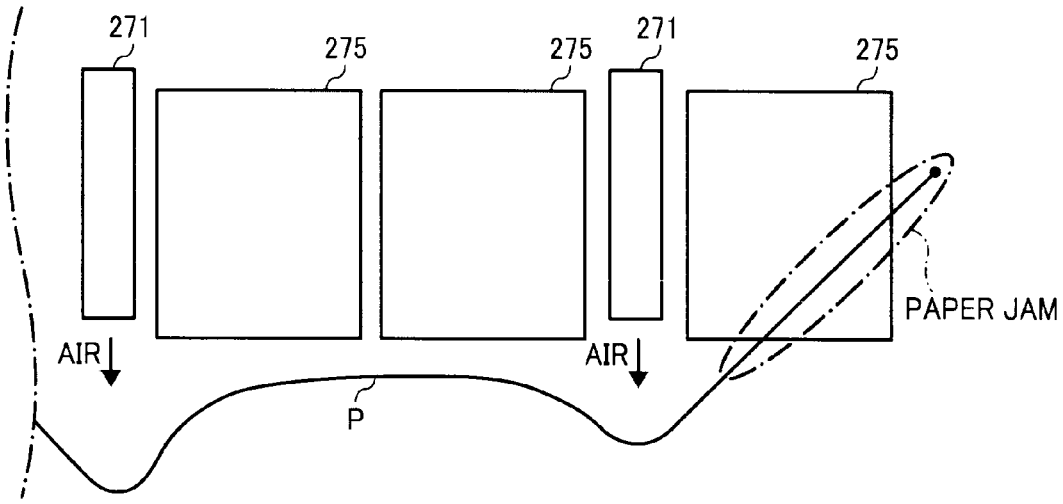
FIG. 14 BACKGROUND ART
FIG. 14 is a view schematically illustrating a waving state of the sheet edge portion in the media separator of FIG. 12.

FIG. 12 is another example of the media separator including air nozzles and separation plates, in which the separation plates are provided at both lateral ends (outermost sides). In this case, as illustrated in FIG. 13, the sheet edges are positioned outside air nozzles 271T positioned at outermost sides. Then, the state of the leading edge of the sheet seen from the sheet ejection direction is waving as illustrated in FIG. 14. At the sheet edge (on the right side of the figure), an effect of the compressed air from the nozzle 271T is weakened, whereby the sheet contacts the separation plate 275T positioned at the right edge and a paper jam occurs. An experiment using a common transfer sheet conducted by the inventor of the present invention shows that, if the sheet edge is separated from the end nozzle 271T by more than 10 mm, waving of the sheet occurs as illustrated in FIG. 14, resulting in a paper jam.

In the media separator according to the present invention, air nozzles 71T, 71T are disposed at the outermost sides (both lateral ends) of members including air nozzles and separation plates as illustrated in FIG. 3 or 10. Accordingly, even when the maximum-sided sheet is to be printed, waving at sheet edge portions can be prevented.

In addition, when a small-sized sheet (with a size smaller than the maximum size) is continuously printed, the temperature of the fixing member in the sheet-passing area is absorbed by the paper and is decreased, but is not absorbed in the non-sheet passing area. Thus, there may be a case in which the temperature rises excessively. However, in the first and second embodiments, during the continuous printing of the small-sized sheets, the compressed air injected from the end air nozzles 71T, 71T blows on the fixing member such as the fixing roller or the fixing belt. Therefore, the excessive temperature rise at both lateral ends (in the case of center reference) of the fixing member may be prevented and the temperature balance in the longitudinal direction of the fixing member may be improved.

Without limited to the so-called small-sized paper, when printing is performed using the standard B5 longer side sheet passing corresponding to the B4 shorter side length and the standard A4 shorter side sheet passing as illustrated in FIG. 11, the excessive temperature rise at both lateral ends (outside the sheet passing area) of the fixing member may be prevented.

Figure 15:
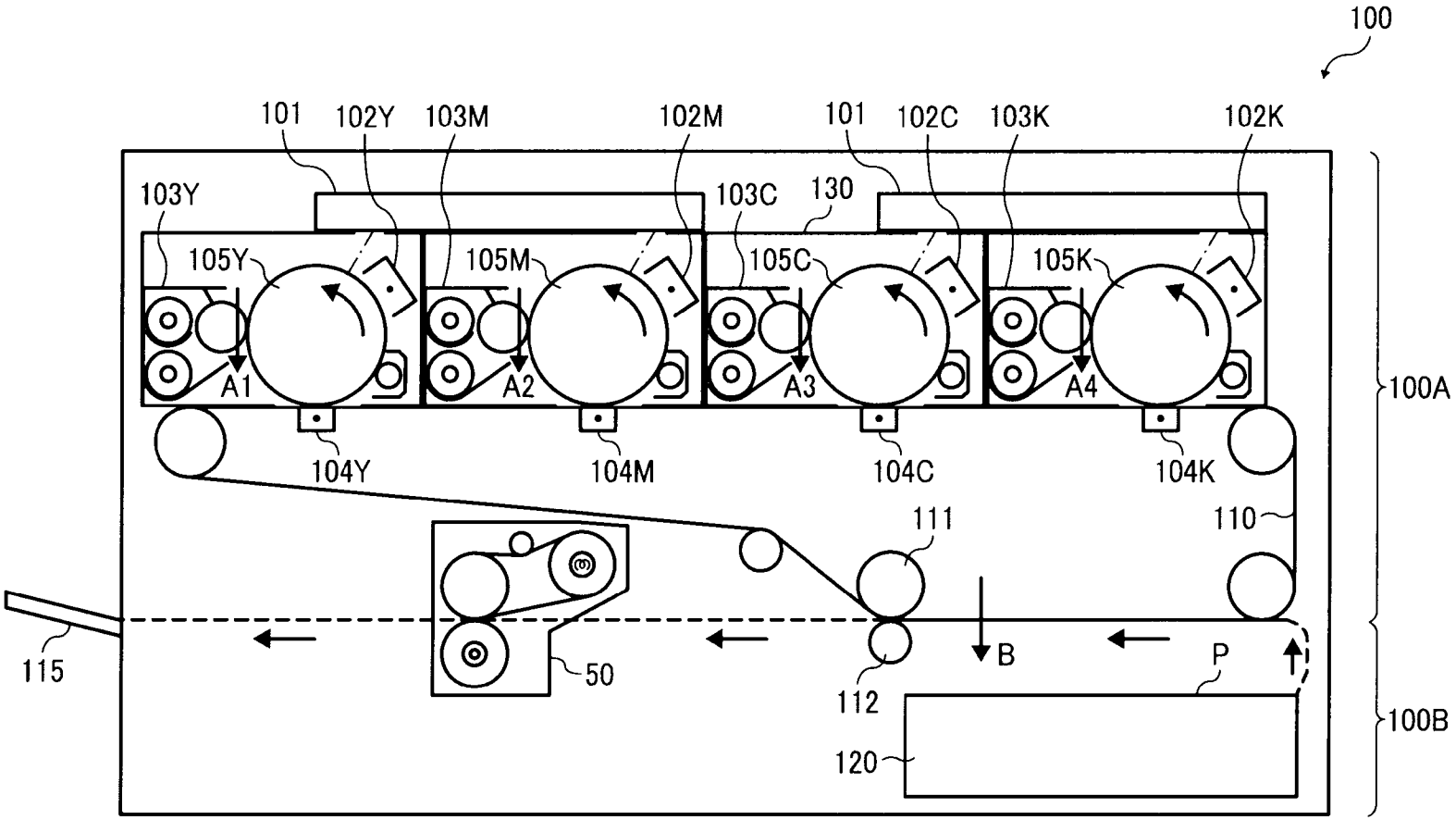
FIG. 15 is a cross-sectional view of an image forming apparatus, as an example, incorporating a fixing device according to an embodiment of the present invention.
Figure 16:
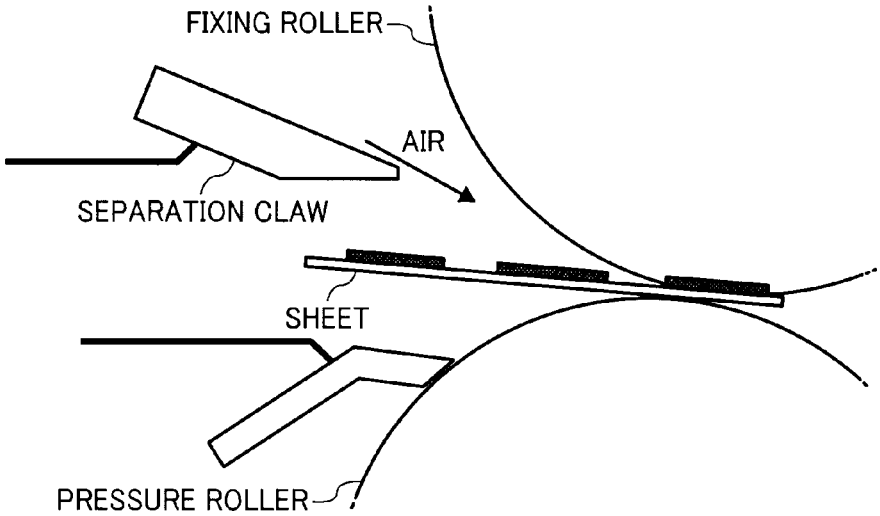
FIG. 16 BACKGROUND ART
FIG. 16 is a schematic view of a portion around the fixing nip illustrating a state in which a sheet is normally separated.
Figure 17:
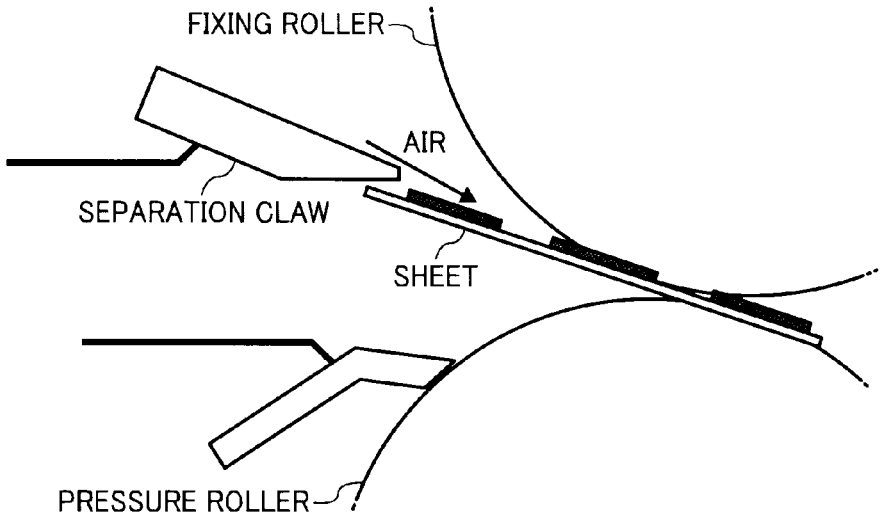
FIG. 17 BACKGROUND ART
FIG. 17 is a schematic view of a portion around the fixing nip illustrating a state in which a sheet winds over the roller.

FIG. 15 shows an example of an image forming apparatus to which the fixing device according to the present invention is mounted.

As illustrated in FIG. 15, the image forming apparatus is configured to be a tandem-type color copier. This color copier 100 includes an image forming section 100A located at the center of the apparatus body; a sheet feed section 100B located in the bottom of the image forming section 100A; and an image reading section, not shown, located at an upper side of the image forming section 100A, thereby forming a high-speed image forming apparatus. The image forming section 100A incorporates a fixing device 50.

The image forming section 100A includes an intermediate transfer belt 110 having a transfer surface extending in the horizontal direction. Components to form an image of a complementary color with respect to a decomposed color are provided on its outer surface of the intermediate transfer belt 110. Specifically, photoreceptors 105Y, 105M, 105C, and 105K to carry an image thereon, each as an image carrier of the color of toner (yellow, magenta, cyan, and black) having a relation of a complementary color with each other, are disposed along the transfer surface of the intermediate transfer belt 110.

Each of the photoreceptors 105Y, 105M, 105C, and 105K is formed of a drum rotatable in the same direction (i.e., counterclockwise direction in the figure), and an optical writing unit 101, a charger 102Y, 102M, 102C, and 102K, a developing device 103Y, 103M, 103C, and 103K, a primary transfer device 104Y, 104M, 104C, and 104K, and a cleaning device are arranged around each of the photoreceptors 105Y, 105M, 105C, and 105K. In addition, each of the developing devices 103Y, 103M, 103C, and 103K includes color toner of respective color. The photoreceptor 105, the charger 102, the developing device 103, and the like integrally form an image forming unit.

The intermediate transfer belt 110 is stretched over a drive roller and a driven roller and is configured to move in the same direction as that of the photoreceptor at a position opposite each of the photoreceptors 105Y, 105M, 105C, and 105K. A secondary transfer roller 112 is disposed at a position opposite a roller 111, one of the driven rollers. The conveyance path of the sheet P from the secondary transfer roller 112 to the fixing device 50 is horizontal. As aforementioned, the fixing device 50 includes a media separator 70 (or 170) by air separation method.

The sheet feed section 100B includes a sheet feed tray 120 to accommodate sheets P as recording media and a conveyance mechanism to separate the sheet one by one from the topmost sheet among the sheets P inside the sheet feed tray 120 and convey it to the position of the transfer roller 112.

Image forming operation in the color copier 100 is as follows. A surface of the photoreceptor 105Y is uniformly charged by the charger 102Y, and an electrostatic latent image is formed on the photoreceptor 105Y based on the image information from an image reading section. The electrostatic latent image is visualized by the developing device 103Y accommodating yellow toner, and the toner image is primarily transferred to the intermediate transfer belt 110 by the primary transfer device 104Y to impress a predetermined bias to the toner image. Similar image forming operation is performed in the other photoreceptors 105M, 105C, and 105K using different color of toner and the toner images of different colors are sequentially superimposed on the intermediate transfer belt 110 with electrostatic force to form an overlaid toner image.

The toner image primarily transferred from the photoreceptors 105Y, 105M, 105C, and 105K to the intermediate transfer belt 110 is transferred onto the sheet P which has been conveyed to a position between the roller 111 and the secondary transfer roller 112. The sheet P on which the toner image has been transferred is further conveyed to the fixing device 50 and the toner image is fixed onto the sheet P at the fixing nip formed between the fixing belt 51 and the pressure roller 56. The media separator 70 (or 170) is disposed at the way out of the fixing nip, and the sheet P is discharged from the way out of the fixing nip without winding around the fixing belt 51 or the pressure roller 56 by the injected air from the air nozzles.

Subsequently, the sheet P ejected from the fixing nip is sent along the sheet ejection path to a stacker 115, a sheet ejection section.

As described above, the color copier 100 according to the present embodiment includes a fixing device 50 provided with a media separator and exerts a high separation function after fixation regardless of the variety of sheets and images. In particular, waving of the sheet at an edge portion thereof is effectively prevented, the occurrence of the paper jam is prevented, and the stable sheet separation and sheet conveyance are enabled.

The present invention is not limited to the description heretofore, and the number of air nozzles and separation plates and the order thereof can arbitrarily be set within a scope of the present invention in which the air nozzles are disposed at lateral outermost sides. In addition, shape and structure of the air nozzles, largeness, shape, and structure of the separation plate may arbitrarily be set. Materials thereof can also be selected appropriately. How to support the air nozzles and the separation plates is also arbitrary. The device layout to supply air to the air nozzles can also be arbitrary including the conventionally known layout.

The structure of the fixing device is arbitrarily selected. Any common halogen lamp, induction heating means, and the like may be used for the fixing heater. The pressure member may also include heating means.

Each structure of the image forming apparatus is arbitrary. For example, without limited to the tandem method, any arbitrary image forming method can be used. Not limited to the intermediate transfer method, the present invention may also be applied to the direct transfer method. The present invention may be applied to the full-color copier using three colors of toner, multi-color copier using at least two colors of toner, and a monochrome copier. The image forming apparatus according to the present invention is not limited to a copier, but may be a printer and a facsimile machine, and further a multi-functional apparatus including functions of copier, printer, facsimile machine, and the like.

Additional modifications and variations of the present invention are possible in light of the above teachings. It is therefore to be understood that, within the scope of the appended claims, the invention may be practiced other than as specifically described herein.

What is claimed is:

1. A media separator configured to separate a recording medium conveyed from a fixing nip formed of a fixing member and a pressure member from the fixing member or the pressure member, the media separator comprising:

a plurality of air nozzles; and at least one separation plate, the plurality of air nozzles and the at least one separation plate being disposed as a row of members arranged along a longitudinal axis of the media separator and perpendicular to a direction of conveyance of the recording medium, wherein two of the plurality of air nozzles are disposed at both lateral ends of the row of members in the longitudinal axis of the media separator, such that no separation plate is present in the row of members at a position closer to the lateral ends of the row of members than the two of the plurality of air nozzles.

2. The media separator as claimed in claim 1, wherein the two air nozzles disposed at both lateral ends of the row of members are disposed at positions substantially coincident with both lateral ends in the width direction of a maximum printable media size which can be accommodated by a fixing device in which the media separator is mounted.

3. The media separator as claimed in claim 1, wherein the two air nozzles disposed at both lateral ends of the row of members are disposed at positions inboard of a maximum printable media size which can be accommodated by a fixing device in which the media separator is mounted.

4. The media separator as claimed in claim 3, wherein the two air nozzles disposed at both lateral ends of the row of members are disposed at positions outside the width of a maximum standard media size among types of media smaller than the maximum printable media size.

5. The media separator as claimed in claim 1, wherein the plurality of air nozzles include air nozzles disposed at positions corresponding to both lateral ends of a sheet when a size of the sheet frequently used for the fixing device in which the media separator is mounted is passed.

6. The media separator as claimed in claim 1, wherein the air nozzles and the at least one separation plate are supported without contacting the fixing member.

7. The media separator as claimed in claim 1, wherein the air nozzles and the at least one separation plate are disposed to have an adjustable gap with the fixing member.

8. The media separator as claimed in claim 1, further comprising fluorine resins coating at least part of a surface of the air nozzles and the at least one separation plate.

9. The media separator as claimed in claim 1, wherein the air nozzles and the at least one separation plate are formed of fluorine resins.

10. A fixing device comprising a media separator as claimed in claim 1.

11. An image forming apparatus comprising the fixing device as claimed in claim 10.

* * * * *